US006684836B2

(12) United States Patent
Inoue

(10) Patent No.: US 6,684,836 B2
(45) Date of Patent: Feb. 3, 2004

(54) INTERNAL COMBUSTION ENGINE

(75) Inventor: Takahito Inoue, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/338,640

(22) Filed: Jan. 9, 2003

(65) Prior Publication Data

US 2003/0145814 A1 Aug. 7, 2003

(30) Foreign Application Priority Data

Feb. 5, 2002 (JP) ..... 2002-028435

(51) Int. Cl.[7] ..... F01L 1/34

(52) U.S. Cl. ..... 123/90.17; 123/90.12; 123/90.15; 123/90.38; 123/195 C; 123/198 E

(58) Field of Search ..... 123/90.17, 90.12, 123/90.13, 90.15, 90.18, 90.27, 90.31, 90.37, 90.38, 193.1, 193.3, 193.5, 195 A, 195 C, 198 E

(56) References Cited

U.S. PATENT DOCUMENTS

| | | | | |
|---|---|---|---|---|
| 5,189,999 A | | 3/1993 | Thoma | 123/90.17 |
| 6,076,492 A | * | 6/2000 | Takahashi | 123/90.17 |
| 6,182,624 B1 | | 2/2001 | Ozeki | 123/90.33 |
| 6,289,861 B1 | * | 9/2001 | Suzuki | 123/90.17 |
| 6,302,071 B1 | * | 10/2001 | Kobayashi | 123/90.16 |

FOREIGN PATENT DOCUMENTS

| | | | |
|---|---|---|---|
| EP | 0 808 997 | A1 | 11/1997 |
| EP | 1 046 793 | A2 | 10/2000 |
| EP | 1 081 340 | A2 | 3/2001 |
| JP | 4-109007 | A | 4/1992 |
| JP | 7-166831 | A | 6/1995 |
| JP | 7-217412 | A | 8/1995 |
| JP | 8-260931 | A | 10/1996 |
| JP | 10-37722 | A | 2/1998 |
| JP | 10-196324 | A | 7/1998 |
| JP | 11-303618 | A | 11/1999 |
| JP | 2000-120414 | A | 4/2000 |

OTHER PUBLICATIONS

U.S. Patent Application Publication 2002/0014214, Katayama, Feb. 7, 2002, "Variable Valve Timing Structure for Outboard Motor Engine".*

* cited by examiner

*Primary Examiner*—Thomas Denion
*Assistant Examiner*—Kyle Riddle
(74) *Attorney, Agent, or Firm*—Foley & Lardner

(57) ABSTRACT

An internal combustion engine is provided which comprises a variable valve timing mechanism provided at an end of a camshaft and actuated by oil pressure for varying a valve timing, an oil pressure control valve that controls the oil pressure, and an oil passage fluidly connecting between the oil pressure control valve and the variable valve timing mechanism, wherein the oil pressure control valve is installed on a head cover, and wherein the oil passage includes a first oil passage section formed in the camshaft and in communication with the variable valve timing mechanism, a second oil passage section formed in the head cover and in communication with the oil pressure control valve, and a third oil passage section formed in the cam bracket and provides communication between the first oil passage section and the second oil passage section.

10 Claims, 9 Drawing Sheets

I
I
32
27b, 28b
40c
19
34
15
13
13
13
14
18
18
18
35
31
40b
35
33
28e
27e
D1
28a
21
22
20
10

INTERNAL COMBUSTION ENGINE

BACKGROUND OF THE INVENTION

The present invention relates to an internal combustion engine that has at an end of a camshaft a variable valve timing mechanism for varying a valve timing depending upon a variation of oil pressure.

An internal combustion engine that has at an end of a camshaft for driving an intake valve and/or exhaust valve a variable valve timing mechanism that is actuated by oil pressure for varying a valve timing of the intake valve and/or exhaust valve is known and suited for automotive vehicles. In an internal combustion engine disclosed in Japanese Patent Provisional Publication No. 4-109007, an oil pressure control valve for controlling the oil pressure of a variable valve timing mechanism is positioned higher than a camshaft that is formed with an oil passage in communication with the variable valve timing mechanism so that air bubbles are not contained in the hydraulic oil to be supplied to the variable valve timing mechanism.

Further, in the internal combustion engine disclosed in the above-described Japanese Patent Publication, a head cover (cam carrier) that covers an upper portion of a cylinder head at which the camshaft is provided is formed integral with cam brackets that cooperate with the cylinder head to rotatably support therebetween the camshaft. Namely, the cam brackets to be fixed to the cylinder head while interposing therebetween the camshaft are formed integral with the head cover.

SUMMARY OF THE INVENTION

In general, the head cover is attached to the cylinder head in a floating state mainly for suppressing transmission of vibrations from the cylinder head side. However, in case a head cover has a plurality of integral cam brackets as disclosed in Japanese Patent Publication No. 4-109007, it is required that the head cover be firmly fastened at those bracket portions to the cylinder head, thus making it difficult to attain the floating structure and possibly deteriorating the sound and vibration isolation ability. Further, the integral cam brackets requires the head cover to have an increased strength and rigidity, thus resulting in an increased weight and thickness of the head cover.

It is accordingly an object of the present invention to provide an internal combustion engine that is free from the above noted problems.

According to an aspect of the present invention, there is provided an internal combustion engine comprising a camshaft that drives an engine valve, a cam bracket fixed to a cylinder head and rotatably supporting therebetween the camshaft, a head cover that covers an upper portion of the cylinder head at which the camshaft and the cam bracket are provided, a variable valve timing mechanism provided at an end of the camshaft and actuated by oil pressure for varying a valve timing, an oil pressure control valve that controls the oil pressure, and an oil passage fluidly connecting between the oil pressure control valve and the variable valve timing mechanism, wherein the oil pressure control valve is installed on the head cover, and wherein the oil passage includes a first oil passage section formed in the camshaft and in communication with the variable valve timing mechanism, a second oil passage section formed in the head cover and in communication with the oil pressure control valve, and a third oil passage section formed in the cam bracket and providing communication between the first oil passage section and the second oil passage section.

According to a further aspect of the present invention, there is provided an internal combustion engine comprising a camshaft that drives an engine valve, a variable valve timing mechanism provided at an end of the camshaft and actuated by oil pressure for varying a valve timing, an oil pressure control valve that controls the oil pressure, and a pair of oil passages extending through at least the camshaft and fluidly connecting between the oil pressure control valve and the variable valve timing mechanism, wherein an axis of the oil pressure control valve crosses an axis of the camshaft nearly at right angles.

DESCRIPTION OF THE PREFERRED EMBODIMENT

Figure 3:
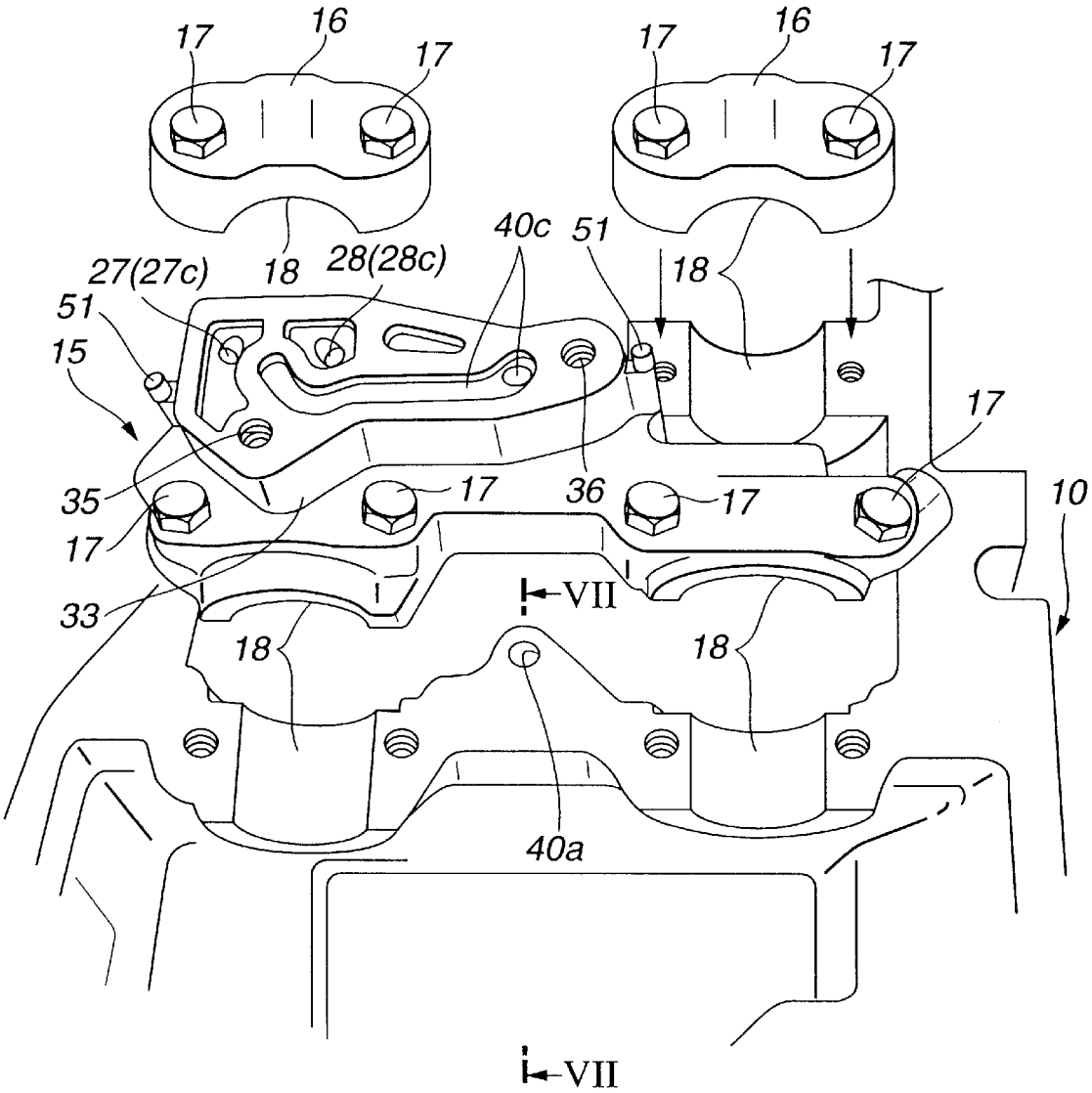
FIG. 3 is a perspective view of an important portion of the embodiment.

Referring to the attached drawings, an internal combustion engine according to an embodiment of the present invention will be described. On cylinder head 10 of the internal combustion engine are disposed intake camshaft 11 and an exhaust camshaft (not shown) in parallel with each other. Each camshaft 11 includes a plurality of cams 13 for driving intake and exhaust valves (not shown) and a plurality of journal portions 14. Cam brackets 15, 16 are fastened with bolts 17 to cylinder head 10, with journal portions 14 being placed therebetween. Cam brackets 15, 16 and cylinder head 10 are respectively formed with bearing portions 18 of a semicircular cross section. In the meantime, cam bracket 15 located nearest to variable valve timing mechanism 22 that will be described later, i.e., located adjacent a front end of the internal combustion engine is formed with oil passages that will be described later and has a pair of journal portions 18 that are positioned adjacent to each other for supporting the intake and exhaust camshafts, respectively. Other cam brackets 16, as shown in FIG. 3, are independent from each other with respect to each journal portion 14 and disposed on the intake and exhaust sides mainly for the purpose of compactness and lightweight.

The upper portion of cylinder head 10 at which camshafts 11 and cam brackets 15, 16 are disposed is covered by head cover 19. Head cover 19 is attached in a floating state to an upper side peripheral portion of cylinder head 10. Concretely, between a lower side peripheral portion of head cover 19 and the upper side peripheral portion of cylinder head 10 is disposed cover gasket 20 having a good sealing ability and a good vibration isolation ability. At the front end of camshaft 11 is coaxially disposed cam sprocket 21, and by way of cam sprocket 21 and timing chain (not shown) is transmitted a rotational force from a crankshaft (not shown) to camshaft 11.

Figure 4:
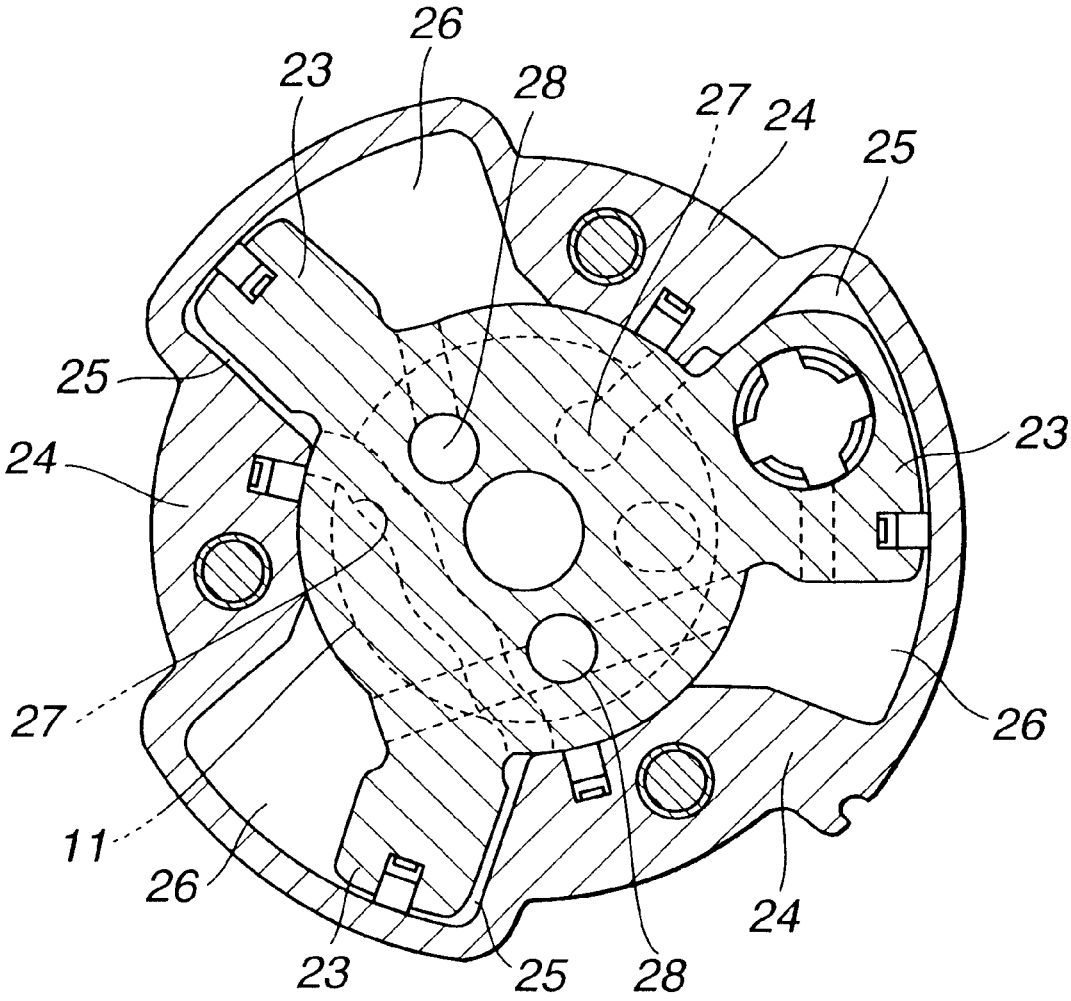
FIG. 4 is a sectional view of a variable valve timing mechanism of the embodiment.

At a front end of intake camshaft 11 is disposed vane-type variable valve timing mechanism 22 that is actuated by oil pressure for varying the valve timing of the intake valve continuously. Since the structure itself of variable valve timing mechanism 22 is known, brief description thereof will be made with reference to FIG. 4. Variable valve timing mechanism 22 includes a rotor (no numeral) rotatable with camshaft 11 and having a plurality of vanes 23. Between each vane 23 and side wall portion 24 rotatable with cam sprocket 21 (refer to FIG. 2) and on opposite sides of each vane 23 are defined advance side oil pressure chamber 25 and retard side oil pressure chamber 26. Advance side oil pressure chambers 25 are fluidly connected by way of advance oil passage 27 to oil pressure control valve 30 (refer to FIG. 1) and retard side oil pressure chambers 26 are fluidly connected by way of retard oil passage 28 to oil pressure control valve 30. By varying and maintaining the oil pressure within oil pressure chambers 25, 26 as desired thereby varying and maintaining the phase of camshaft 11 as desired by means of oil pressure control valve 30, the valve timing of the intake valve can be varied continuously (in a stepless manner) and maintained as desired. Concretely, by making relatively higher the oil pressure within advance side oil pressure chamber 25, the valve timing is advanced. By making relatively higher the oil pressure within retard side oil pressure chamber 26, the valve timing is retarded. By holding unchanged the oil pressures within both oil pressure chambers 25, 26, camshaft 11 is held rotationally unchanged relative to cam sprocket 21, thus making it possible to maintain the present valve timing.

Figure 1:
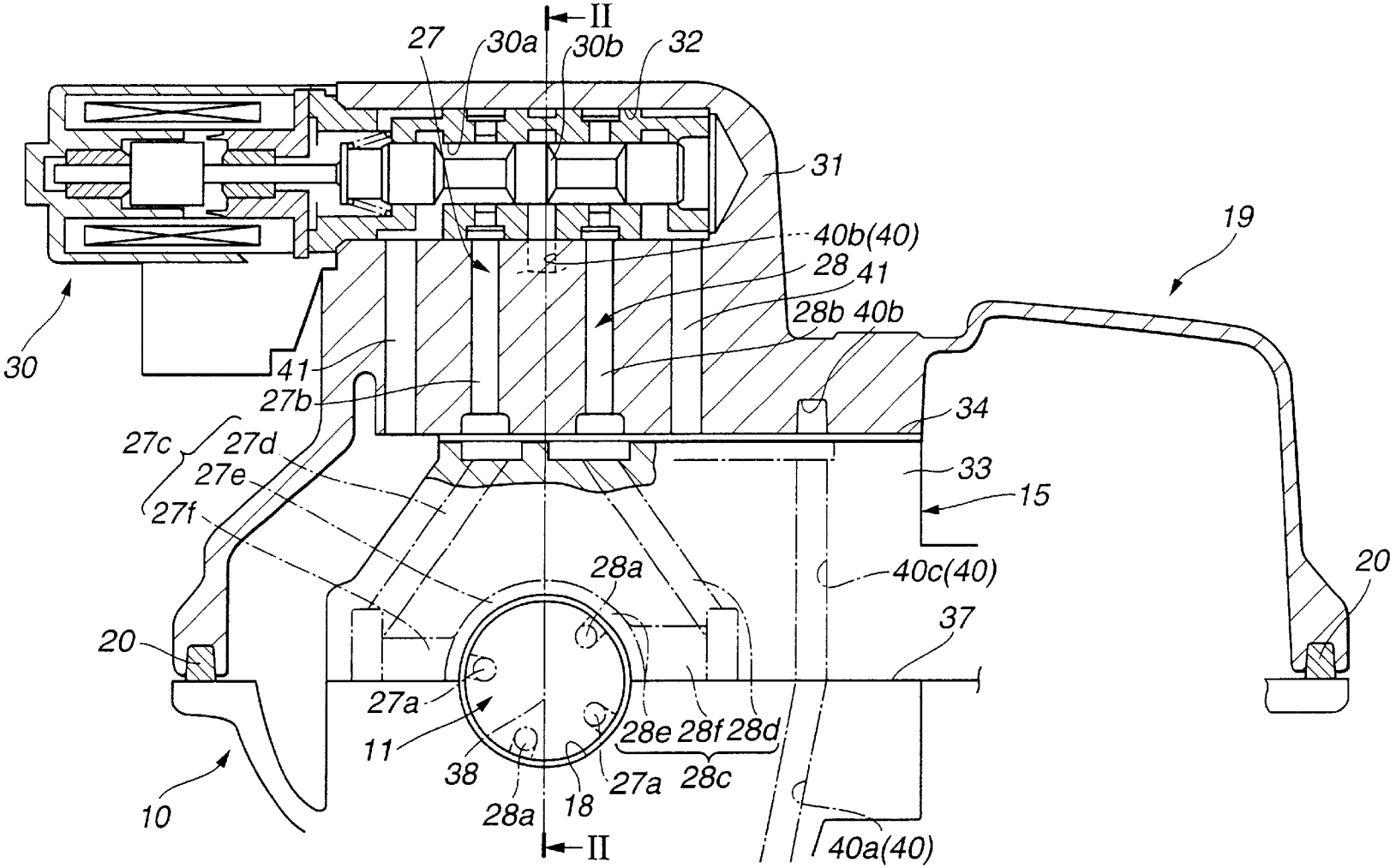
FIG. 1 is a sectional view taken along the line I—I of FIG. 2 and shows an internal combustion engine according to an embodiment of the present invention.
Figure 2:
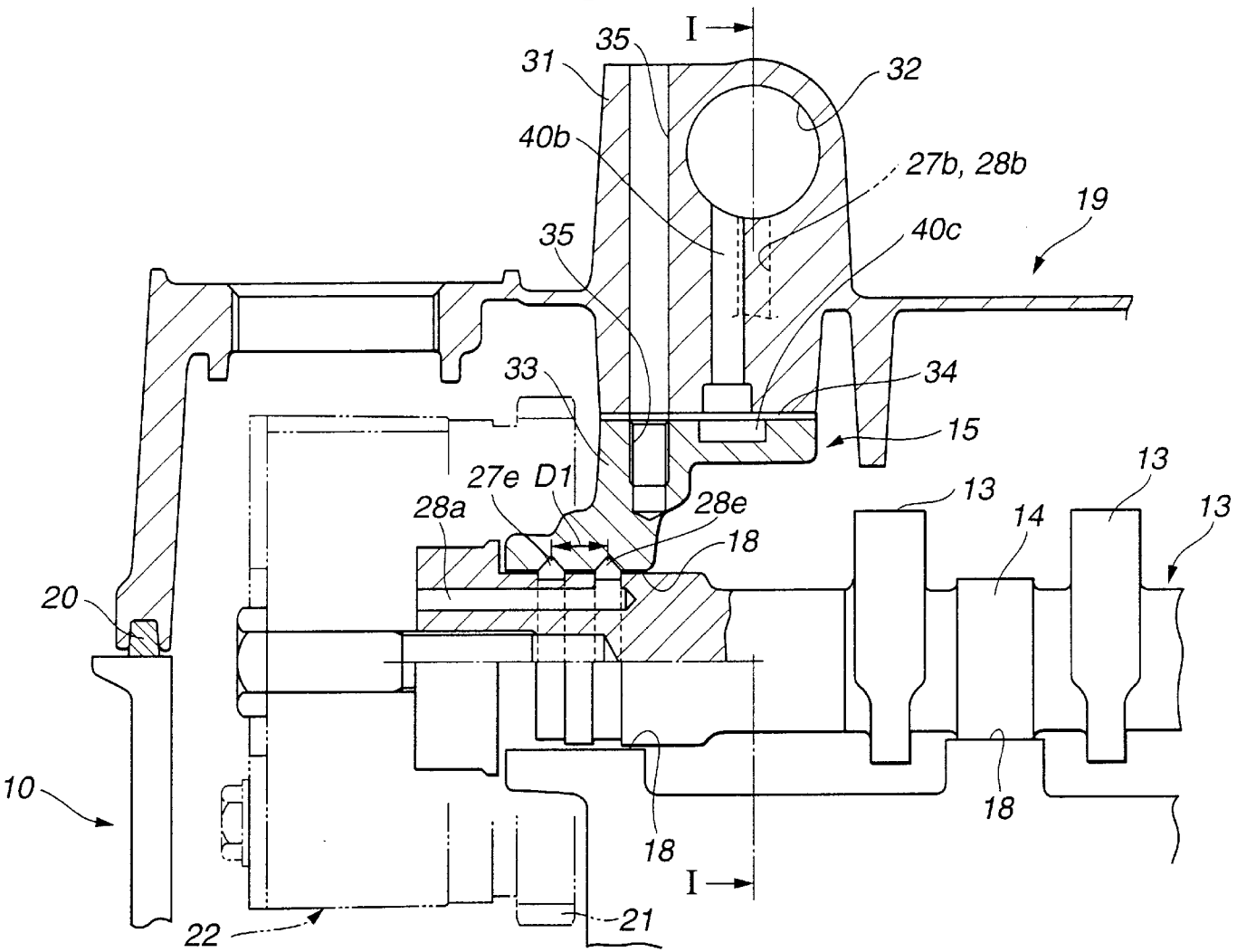
FIG. 2 is a sectional view taken along the line II—II of FIG. 1.

As shown in FIGS. 1 and 2, above-described oil pressure control valve 30 is installed on head cover 19 so that an axis of oil pressure control valve 30 crosses an axis of camshaft 11 at right angles when observed in a plan view. Namely, the upper wall of head cover 19 has first thick-walled portion 31 formed with valve insertion hole 32 in which oil pressure control valve 30 is fitted and fixed. More concretely, oil pressure control valve 30 includes valve bore 30*a* and valve spool 30*b* axially movable in valve bore 30*a*. Oil pressure control valve 30 is disposed so that the axis of valve bore 30*a* or valve spool 30*b* crosses the axis of camshaft 11 at right angles when observed in a plan view. In the meantime, almost all upper wall portion of head cover 19 other than first thick-walled portion 31 is not in contact with small-sized cam brackets 16, etc. at all and is sufficiently thin-walled for the purpose of attaining lightweight. Cam bracket 15 has second thick-walled portion 33 projecting toward first thick-walled portion 31. To second thick-walled portion 33 is attached in a floating state first thick-walled portion 31. Namely, both thick-walled portions 31 and 33 are fixed to each other with two bolts 17 screwed into threaded holes 35, 36 by interposing therebetween gasket 34 having a good sealing ability and a good vibration isolation ability.

Thick-walled portion 31 of head cover 19 and thick-walled portion 33 of cam bracket 15 are formed with part of various oil passages in communication with oil pressure control valve 30. In order that those oil passages can be formed with ease, they are formed in the constituent parts so as to have a straight shape by drilling or formed by denting the surfaces of the constituent parts as will be described later.

Specifically, advance oil passage 27 is generally constituted by first advance oil passage section 27*a* formed in camshaft 11 and in communication with variable valve timing mechanism 22, second advance oil passage section 27*b* formed in head cover 19 and in communication with oil pressure control valve 30, and third advance oil passage section 27*c* formed in cam bracket 15 and providing communication between first advance oil passage section 27*a* and second advance oil passage section 27*b*. Similarly, retard oil passage 28 is generally constituted by first retard oil passage section 28*a* formed in camshaft 11 and in communication with oil pressure control valve 30, second retard oil passage section 28*b* formed in head cover 19 and in communication with oil pressure control valve 30, and third retard oil passage section 28*c* formed in cam bracket 15 and providing communication between first retard oil passage section 28*a* and second retard oil passage section 28*b*.

First advance oil passage section 27*a* and first retard oil passage section 28*a* extend generally through the inside of camshaft 11 and axially of the same straightly. Second advance oil passage section 27*b* and second retard oil passage section 28*b* extend through the inside of head cover 19 in parallel with each other and straightly and disposed at the same camshaft axial position (i.e., at the axial position at which the sectional view of FIG. 1 is taken). Further, second advance oil passage section 27*b* and second retard oil passage section 28*b* are disposed symmetrically with respect to reference plane 38 that extends through the center of camshaft 11 and perpendicularly to head cover attaching surface 37 (refer to FIG. 1).

Third oil passage sections 27*c*, 28*c* are respectively formed so as to extend through cam bracket 15 from the upper surface to the lower surface thereof. Third oil passage sections 27*c*, 28*c* are constituted by internal oil passage portions 27*d*, 28*d* communicated at the upper ends thereof with second oil passage sections 27*b*, 28*b* of head cover 19, circumferential oil passage portions 27*e*, 28*e* of semi-circular cross section, formed in bearing portion 18 by denting and communicated with ends of first oil passage sections 27*a*, 28*a*, and communication oil passage portions 27*f*, 28*f* formed in the lower surface of cam bracket 15 by denting and providing communication between internal oil passage portions 27*f*, 28*f* and circumferential oil passage portions 27*e*, 28*e*. As shown in FIG. 1, internal oil passage portions 27*d*, 28*d* are disposed at generally the same axial position and nearly symmetrically with respect to reference plane 38. Further, internal oil passage portions 27*d*, 28*d* are inclined so as to form nearly the same angle with respect to reference plane 38 and surround camshaft 11.

Figure 5:
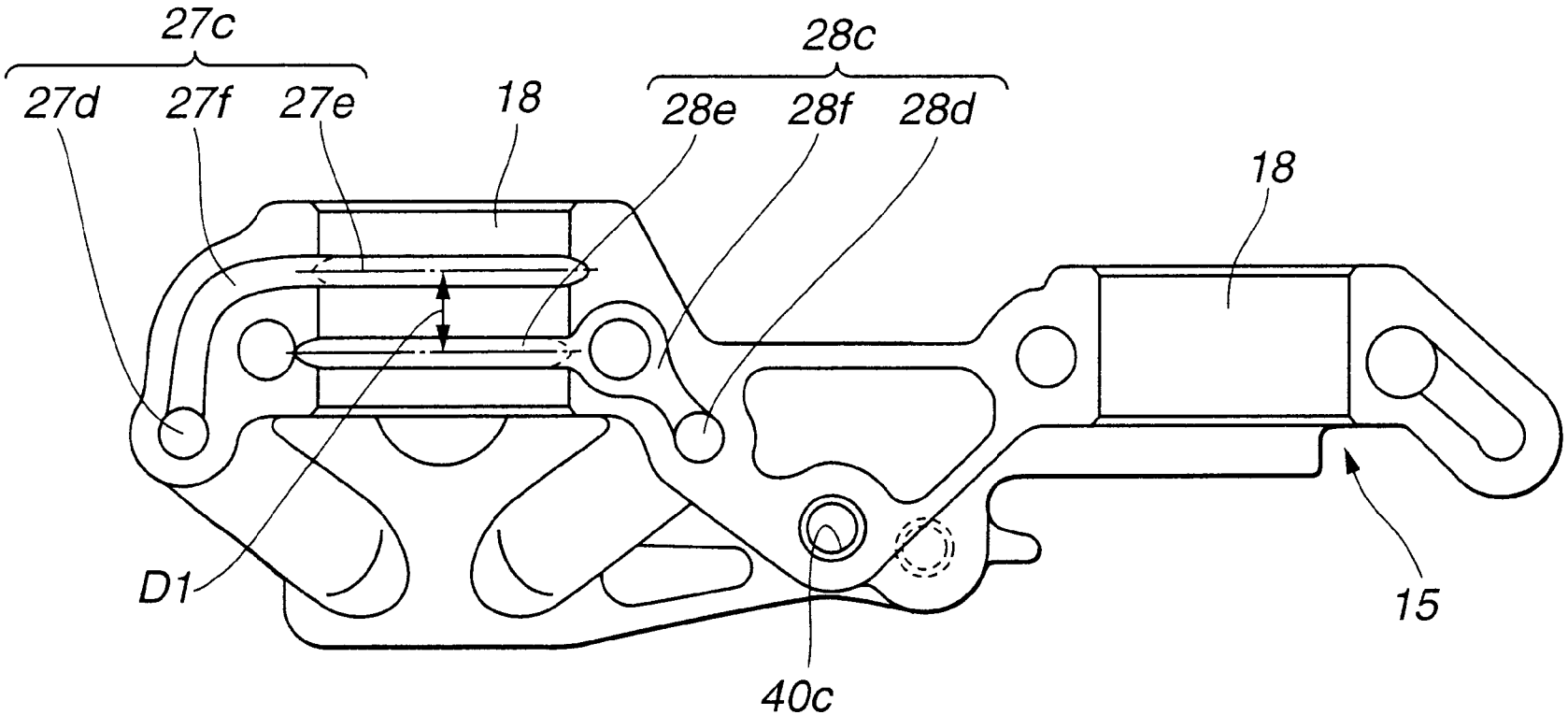
FIG. 5 is a bottom view of a cam bracket of the embodiment.
Figure 6:
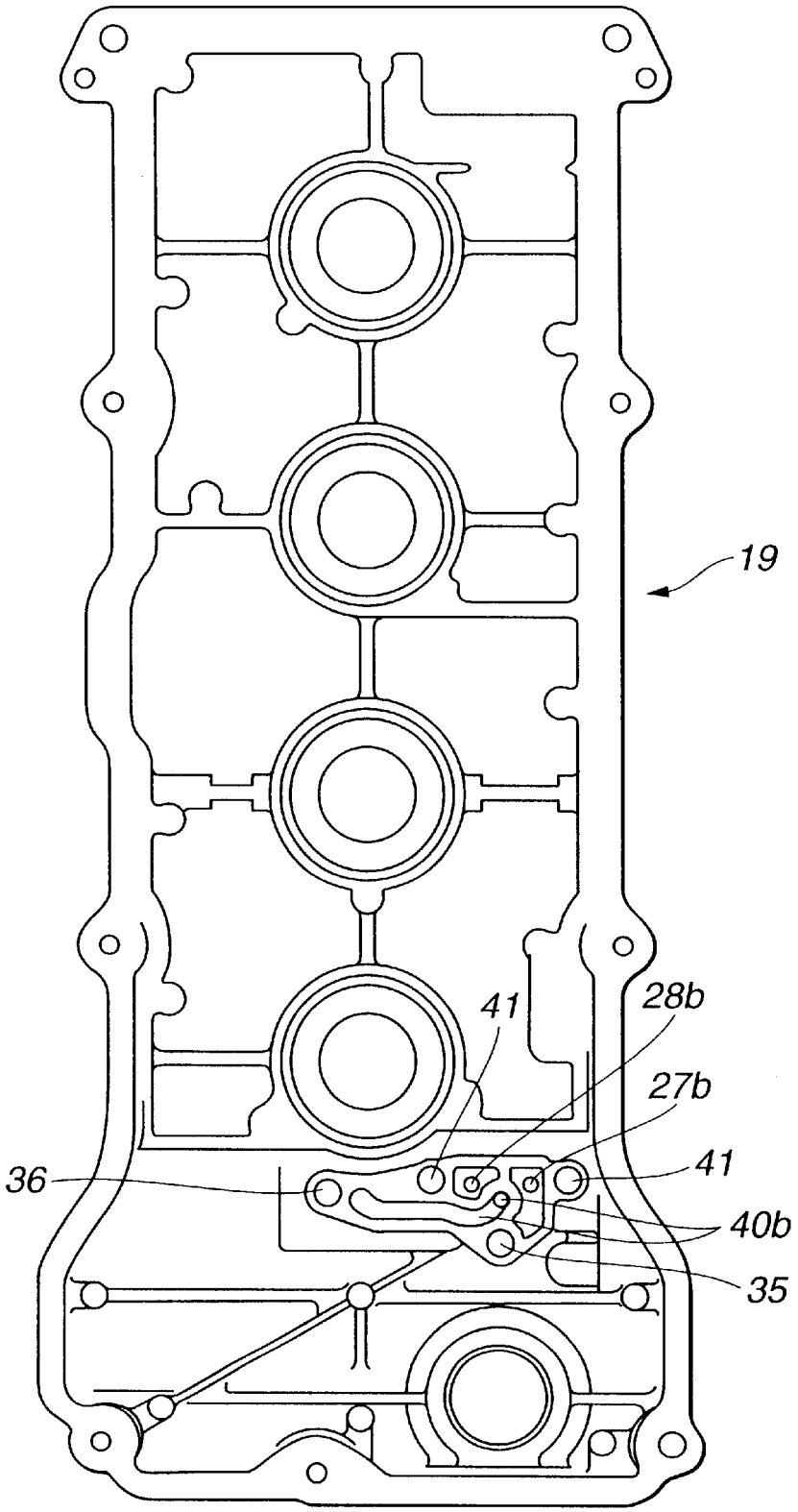
FIG. 6 is a bottom view of ahead cover of the embodiment.

As shown in FIGS. 2 and 5, distance D1 between advance side circumferential oil passage portion 27*e* and retard side circumferential oil passage portion 28*e* is set sufficiently small so that first advance side oil passage section 27*a* and first retard side oil passage section 28*a* have nearly the same length.

Figure 7:
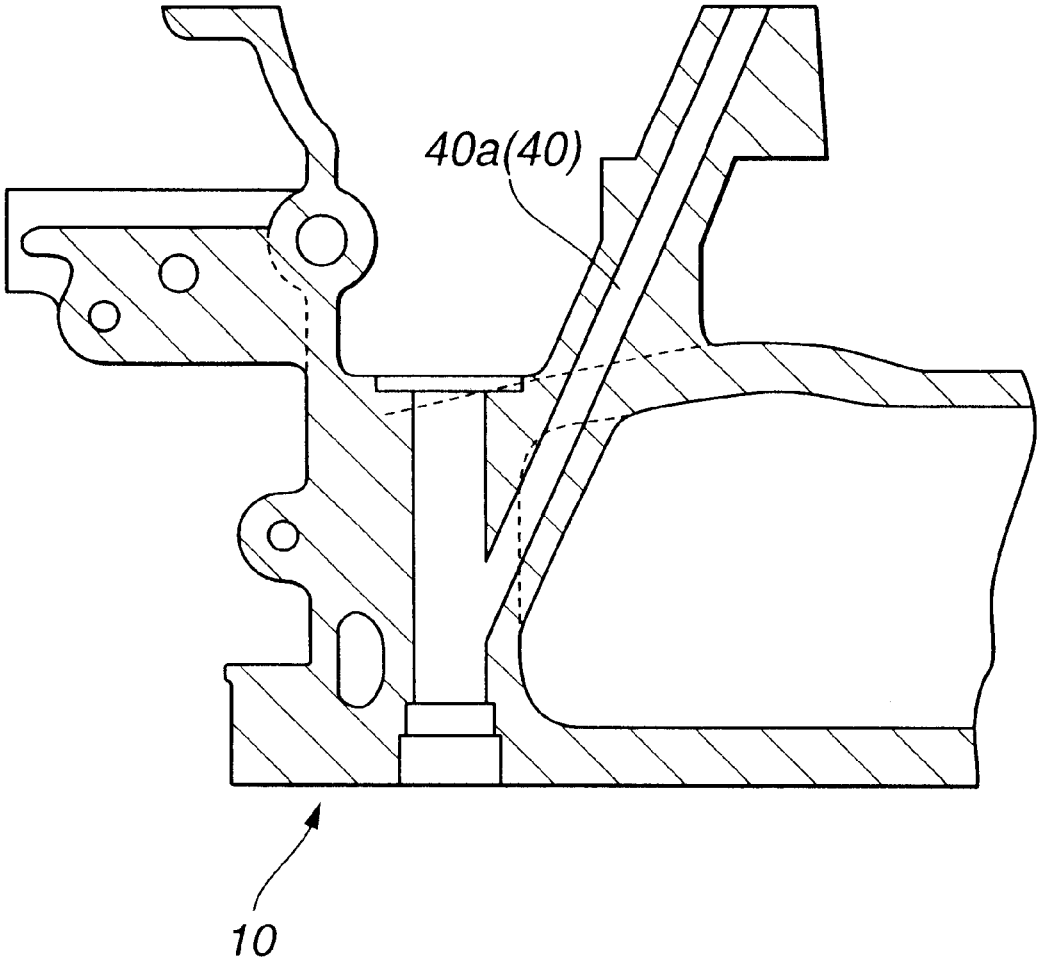
FIG. 7 is a sectional view taken along the line VII—VII of FIG. 3.

Further, as shown in FIGS. 1 and 7, supply oil passage 40 for supplying working oil (oil pressure) from oil pump (not shown) to oil pressure control valve 30 includes first supply oil passage section 40*a* formed in cylinder head 10, second supply oil passage section 40*b* in communication with oil pressure control valve 30, and third supply oil passage section 40*c* formed in cam bracket 15 and providing communication between first supply oil passage section 40*a* and second supply oil passage section 40*b*. Two discharge oil passages 41 for discharging working oil from oil pressure control valve 30 are formed inside head cover 19 so as to extend in parallel with each other and straightly and have an open end at the lower surface of head cover 19. Valve spool 30*b* axially moves in valve bore 30*a* to control communication between second supply oil passage section 40*b* and second advance oil passage section 27*b* and between second supply oil passage section 40*b* and second retard oil passage section 28*b*.

Then, the structural feature and the operational effect of this embodiment will be described.

To head cover 19 is attached oil pressure control valve 30. Second oil passage sections 27*b*, 28*b* and third oil passage sections 27*c*, 28*c* that constitute part of two oil passages 27, 28 connecting between oil pressure control valve 30 and variable valve timing mechanism 22 are formed in head cover 19 and cam brackets 15, respectively. In this manner, oil passages 27, 28 can be formed by a simple structure using head cover 19 that covers the upper portion of cylinder head 10 and cam bracket 15 rotatably supporting cam shaft 11. Further, since cam bracket 15 and head cover 19 are formed independent from each other, transmission of vibrations from cylinder head 10 to head cover 19 can be suppressed as compared with the case where the cam bracket and head cover are formed integral with each other and therefore a good sound and vibration isolation ability can be attained. Further, head cover 19 and cam bracket 15 can be made of different materials, e.g., head cover 19 can be made of a resinous material that is light and economical. Further, since oil passages 27, 28 are partially formed in one cam bracket 15 that is nearest to variable valve timing mechanism 22 and oil pressure control valve 30 is disposed right above that cam bracket 15, oil passages 27, 28 can be made sufficiently shorter and it becomes possible to improve the response of variable valve timing mechanism 22.

Since oil pressure control valve 30 is installed on head cover 19 so that an axis of oil pressure control valve 30 crosses the axis of camshaft 11 at right angles when observed in a plan view, most of second oil passage sections 27*b*, 28*b* and third oil passage sections 27*c*, 28*c* that are formed in head cover 19 and cam bracket 15 can be disposed at substantially the same axial position but respectively on the advance side and the retard side, thus enabling oil passages 27, 28 to be made further shorter and have lengths that are further equalized. More specifically, if the oil pressure control valve is disposed so that an axis of the oil pressure control valve is parallel with the axis of the camshaft, one of the advance and retard oil passages connected to the oil pressure control valve inevitably becomes longer by the amount corresponding to the distance between the oil passage sections connected to the oil pressure control valve. In contrast to this, since in this embodiment oil pressure control valve 30 is disposed so that an axis of oil pressure control valve 30 crosses the axis of camshaft 11, second oil passage sections 27*b*, 28*b* and third oil passage sections 27*d*, 28*d* can be straight and disposed at substantially the same axial position, respectively. Accordingly, oil passages 27, 28 can be of substantially the same length and be made sufficiently shorter.

Since portions of oil passages 27, 28, more concretely, most of the second and third oil passage sections formed in head cover 19 and cam bracket 15 are nearly symmetrical with respect to reference plane 38, it can be attained with ease to make oil passages 27, 28 shorter and equal in length. Further, since oil passages 27, 28 are nearly symmetrical, the difference in the response between the advance side and the retard side can be suppressed further.

Since gasket 34 having a good sealing ability and a good vibration isolation ability is interposed between cam bracket 15 and head cover 19, transmission of vibrations from cam bracket 15 to head cover 19 can be prevented assuredly.

Figure 8:
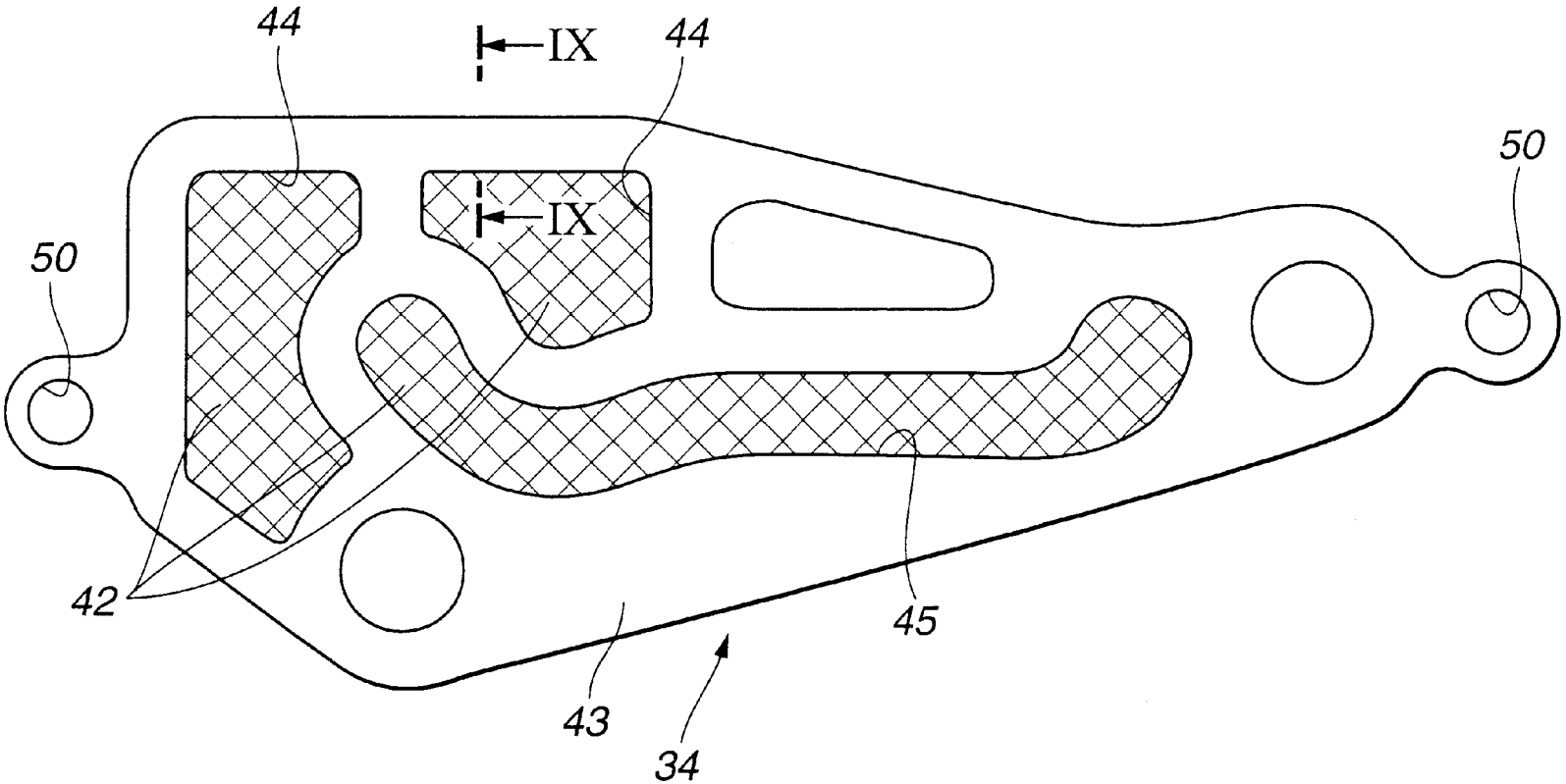
FIG. 8 is a plan view of a gasket of the embodiment.
Figure 9:
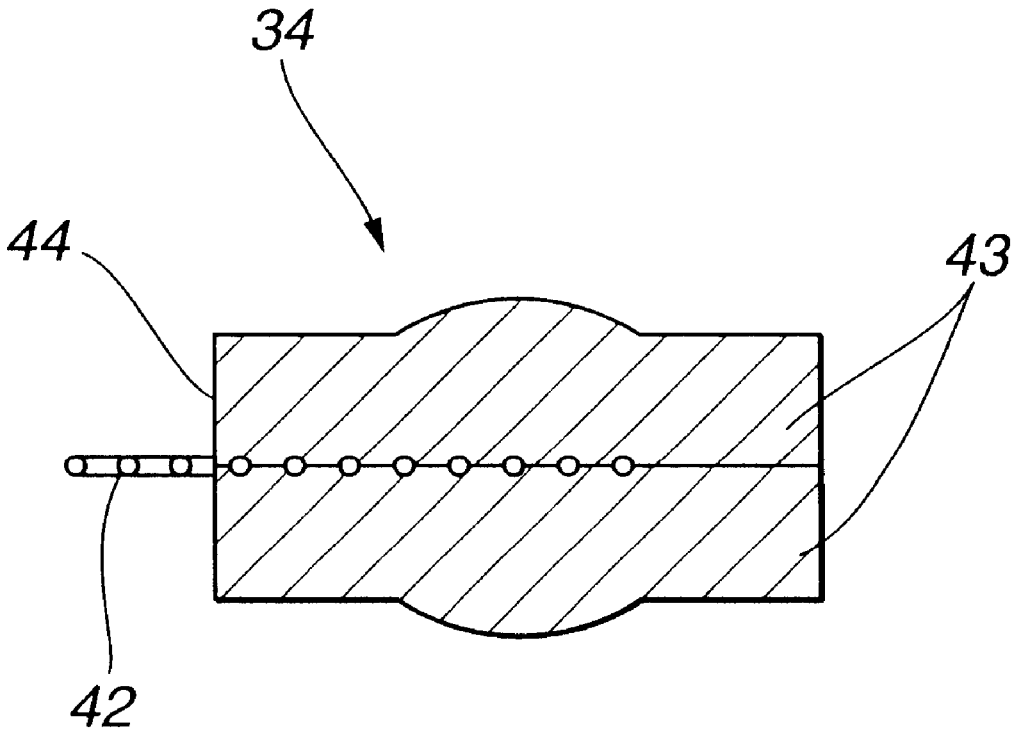
FIG. 9 is a sectional view taken along the line IX—IX of FIG.8.

As shown in FIGS. 8 and 9, gasket 34 has a three-layered structure, i.e., has dustproof filter 42 and two sheets 43 between which dust proof filter 42 is interposed. Filter 42 is exposed at holes 44 providing communication between second oil passage section 27*b*, 28*b* and third oil passage sections 27*c*, 28*c* and hole 45 providing communication between second supply oil passage section 40*b* and third supply oil passage section 40*c*. Namely, filter 42 is interposed between second oil passage sections 27*b*, 28*b* and third oil passage sections 27*c*, 28*c* and between second supply oil passage section 40*b* and third supply oil passage section 40*c*. In this manner, by a simple structure and without increasing the number of constituent parts, a dustproof function can be provided to the oil passages.

As shown in FIGS. 3 and 8, gasket 34 and cam bracket 15 have two positioning holes 50 and two positioning projections 51 to be fitted in positioning holes 50, respectively. Accordingly, by fitting positioning holes 50 of gasket 34 on positioning projections 51 at the time of assembly, gasket 34 can be positioned with respect to cam bracket 15 with ease and assuredness, thus making it possible to improve the assembly work efficiency and reliability.

Since small-sized cam brackets 16 and the head cover 19 portion that is not formed with any oil passage for variable valve timing mechanism 22 do not contact with each other at all, most of the upper wall of head cover 19 can be thin-walled sufficiently and made lighter in weight. Further, to the upper wall of head cover 19 that is thin-walled in the above-described manner is formed integral first thick-walled portion 31 that has a relatively large weight. By the mass damper effect of first thick-walled portion 31, radiation of sound can be suppressed, thus making it possible to attain an improved sound and vibration isolation ability. Namely, first thick-walled portion 31 that is formed with oil passages, etc. is adapted to serve also as a damper mass.

The entire contents of Japanese Patent Application No. P2002-28435 (filed Feb. 5, 2002) are incorporated herein by reference.

Although the invention has been described above by reference to a certain embodiment of the invention, the invention is not limited to the embodiment described above. Modifications and variations of the embodiment described above will occur to those skilled in the art, in light of the above teachings. For example, the present invention can be applied to an internal combustion engine in which a variable valve timing mechanism is used for only the exhaust valve side or for both the exhaust valve side and intake valve side. The scope of the invention is defined with reference to the following claims.

What is claimed is:

1. An internal combustion engine comprising:

a camshaft that drives an engine valve;

a cam bracket fixed to a cylinder head and rotatably supporting therebetween the camshaft;

a head cover that covers an upper portion of the cylinder head at which the camshaft and the cam bracket are provided;

a variable valve timing mechanism provided at an end of the camshaft and actuated by oil pressure for varying a valve timing;

an oil pressure control valve that controls the oil pressure; and an oil passage fluidly connecting between the oil pressure control valve and the variable valve timing mechanism;

wherein the oil pressure control valve is installed on the head cover; and wherein the oil passage includes:

a first oil passage section formed in the camshaft and in communication with the variable valve timing mechanism;

a second oil passage section formed in the head cover and in communication with the oil pressure control valve; and a third oil passage section formed in the cam bracket and providing communication between the first oil passage section and the second oil passage section.

2. An internal combustion engine according to claim 1, wherein an axis of the oil pressure control valve crosses an axis of the camshaft nearly at right angles.

3. An internal combustion engine according to claim 2, wherein the pressure control valve comprises a valve bore and a valve spool axially movable in the valve bore, the axis coincides with an axis of the valve spool.

4. An internal combustion engine according to claim 1, further comprising a gasket interposed between the cam bracket and the head cover.

5. An internal combustion engine according to claim 4, wherein the gasket has a filter interposed between the second oil passage section and the third oil passage section.

6. An internal combustion engine according to claim 1, further comprising an oil passage fluidly connecting between the oil pressure control valve and the variable valve timing mechanism, wherein the second-mentioned oil passage includes a first oil passage section formed in the camshaft and in communication with the variable valve timing mechanism, a second oil passage section formed in the head cover and in communication with the oil pressure control valve, and a third oil passage section formed in the cam bracket and providing communication between the first oil passage section and the second oil passage section of the second-mentioned oil passage, and wherein most of the second oil passage section and the third oil passage section of the first-mentioned oil passage and most of the second oil passage section and the third oil passage section of the second-mentioned oil passage are disposed symmetrical with respect to a reference plane including the axis of the camshaft.

7. An internal combustion engine according to claim 6, wherein the variable valve timing mechanism comprises a vane rotatable with the camshaft and a pair of oil pressure chambers on the opposite sides of the vane, the first-mentioned oil passage is communicated with one of the oil pressure chambers and the second-mentioned oil passage is communicated with the other of the oil pressure chambers.

8. An internal combustion engine according to claim 1, wherein the cam bracket has a bearing portion that cooperates with a corresponding bearing portion of the cylinder head to support therebetween a journal portion of the camshaft.

9. An internal combustion engine according to claim 1, wherein the head cover is installed in a floating state on the cylinder head.

10. An internal combustion engine according to claim 1, further comprising a cam bracket that cooperates with the cylinder head to rotatably support therebetween the camshaft, the second-mentioned cam bracket being held out of contact with the head cover.

* * * * *